US007347063B2

(12) United States Patent
Demuth et al.

(10) Patent No.: US 7,347,063 B2
(45) Date of Patent: Mar. 25, 2008

(54) DEVICE FOR HEAT EXCHANGE

(75) Inventors: Walter Demuth, Leonberg (DE); Martin Kotsch, Ludwigsburg (DE); Karl-Heinz Staffa, Stuttgart (DE); Christoph Walter, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 449 days.

(21) Appl. No.: 10/518,596

(22) PCT Filed: Jul. 22, 2003

(86) PCT No.: PCT/EP03/08003

§ 371 (c)(1),
(2), (4) Date: Dec. 21, 2004

(87) PCT Pub. No.: WO2004/013558

PCT Pub. Date: Feb. 12, 2004

(65) Prior Publication Data

US 2005/0223738 A1 Oct. 13, 2005

(30) Foreign Application Priority Data

Jul. 26, 2002 (DE) ..... 102 34 117
Sep. 9, 2002 (DE) ..... 102 41 843

(51) Int. Cl.
*F25B 39/02* (2006.01)

(52) U.S. Cl. ..... 62/515; 165/150

(58) Field of Classification Search ..... 62/515, 62/507, 498; 165/150, 176
See application file for complete search history.

(56) References Cited

U.S. PATENT DOCUMENTS

| | | | | |
|---|---|---|---|---|
| 3,273,227 | A * | 9/1966 | Pauls | 29/890.042 |
| 3,416,600 | A | 12/1968 | Fink | |
| 5,531,268 | A * | 7/1996 | Hoshino et al. | 165/153 |
| 6,434,972 | B1 | 8/2002 | Geiger et al. | |
| 6,523,606 | B1 * | 2/2003 | Dienhart et al. | 165/144 |
| 6,546,999 | B1 * | 4/2003 | Dienhart et al. | 165/150 |
| 2003/0102113 | A1 * | 6/2003 | Memory et al. | 165/152 |
| 2003/0183378 | A1 * | 10/2003 | Memory et al. | 165/153 |

FOREIGN PATENT DOCUMENTS

| | | |
|---|---|---|
| DE | 198 30 863 A1 | 1/2000 |
| DE | 198 33 845 A1 | 2/2000 |
| EP | 0 845 648 A2 | 6/1998 |
| FR | 2 793 013 A1 | 11/2000 |

* cited by examiner

*Primary Examiner*—Melvin Jones
(74) *Attorney, Agent, or Firm*—Foley & Lardner LLP

(57) ABSTRACT

A device for exchanging heat is disclosed herein. This device may be used in motor vehicle air-conditioning installations which include at least one distribution or collection chamber for a fluid, at least one flow device which is provided with at least one first flow connection section on the end thereof, and at least one second flow connection section on the end thereof, the first flow connection section being connected to the second flow connection section by means of at least one pipe section. At least one of the flow connection sections may be twisted at least once, one flow connection section may be connected to the collection chamber, and the other flow connection section may be connected to the distribution chamber.

49 Claims, 7 Drawing Sheets

DEVICE FOR HEAT EXCHANGE

The invention relates to an apparatus for heat exchange, in particular for use in air-conditioning systems and especially for use in air-conditioning systems which, as refrigerant, include a fluid with carbon dioxide as at least one constituent.

Apparatuses for heat exchange of this type are used, for example, to cool air.

The invention and the technical problems on which it is based will be described below with reference to the example of a motor vehicle air-conditioning system. However, it should be noted that the apparatus according to the invention is also suitable for other intended applications.

The invention also relates to a process for producing an apparatus for heat exchange.

The prior art has disclosed air-conditioning systems in motor vehicles. These air-conditioning systems use a refrigerant which is used to cool air. Examples of refrigerants of this type include chlorofluorocarbons. However, air-conditioning systems which are operated with refrigerants of this type have the drawback of causing a significant increase in the fuel consumption of a motor vehicle. Furthermore, these conventional refrigerants have a very high greenhouse gas potential, and consequently the use of these refrigerants also increases the problems caused by the greenhouse effect. For this reason, in recent times a further refrigerant, namely carbon dioxide ($CO_2$), has been used. Compared to the refrigerants referred to above, carbon dioxide has a considerably lower greenhouse gas potential.

Furthermore, carbon dioxide does not cause any damage to the ozone layer, since it is a natural gas. Finally, the use of carbon dioxide as refrigerant also makes it possible to reduce the fuel consumption of the motor vehicle.

However, one drawback of using carbon dioxide as refrigerant is that very high pressures in the range of up to more than 130 bar have to be produced, and therefore the pressure loading on the individual components of the air-conditioning systems rises significantly, requiring a higher stability. A further problem is that of accommodating the individual components of the air-conditioning system in as space-saving a form as possible in a motor vehicle.

Therefore, the invention is based on the object of providing an apparatus for heat exchange which is distinguished by a high stability, an inexpensive and space-saving design and a high ability to withstand compressive loads. Furthermore, the efficiency of the heat exchange apparatus is to be increased.

According to the invention, the object is achieved by the subject matter of main claim 1. Advantageous refinements form the subject matter of the subclaims. However, it should be noted that not all the objects of the invention are achieved by all the claims.

In one embodiment, an apparatus for heat exchange, in particular for use in motor vehicles, and especially for use in motor vehicle air-conditioning systems which include as refrigerant a fluid which includes as at least one constituent, a fluid selected from a group of gases consisting in particular of carbon dioxide, nitrogen, oxygen, air, ammonia, hydrocarbons, in particular methane, propane, n-butane, and liquids, in particular water, floe ice, brine, etc., has a feed line and a discharge line which open out into at least one distribution space and collection space, respectively, for a fluid. In one particularly preferred embodiment, the refrigerant used is carbon dioxide, which is distinguished by its physical properties, such as noncombustibility.

Furthermore, the apparatus according to the invention for heat exchange has at least one through-flow device which has at least one end-side flow connection section, through which the fluid enters the through-flow device or leaves the through-flow device, and at least one second end-side flow connection section, through which the fluid leaves the through-flow device or enters the through-flow device. The first flow connection section is flow-connected to the second flow connection section through at least one tube section.

In the context of the present invention, the term "flow connected" is to be understood as meaning that the fluid can flow between two flow-connected sections.

Furthermore, the apparatus is distinguished by the fact that at least one of said flow connection sections is twisted at least once. In this context, the term "twisting" is to be understood as meaning that the component is rotated through a defined, predetermined angle along its longitudinal direction.

According to a preferred embodiment, an apparatus for heat exchange in its entirety or at least the through-flow device, as a component of the apparatus, has a preferably gaseous medium, in particular air, flowing around it.

Furthermore, the first or second flow connection section is connected to the collection space, and the second or first flow connection section is flow-connected to the distribution space.

A collection space is to be understood as meaning a device which is suitable for collecting medium supplied to it from at least one component, preferably a plurality of components. The distribution component is used to distribute a fluid which is introduced into it to at least one, preferably a plurality of, devices, in particular through-flow devices.

According to a further preferred embodiment, the tube section has at least one straight section. In this context, a straight section is to be understood as meaning a section which runs substantially parallel to a straight line.

In a further preferred embodiment, the tube section has at least one curved section. A curved section is to be understood as meaning a section which deviates in some way from a straight or rectilinear profile, for example, is angled off by a predetermined angle, curved through a predetermined radius of curvature or the like.

In a further preferred embodiment, the tube section has at least one twisted section, i.e. a section in which the tube section is rotated or coiled along its longitudinal direction. Furthermore, a combination of twisting or bending and/or curvature is also possible. By way of example, it is possible for a section first of all to be twisted along its longitudinal direction and then to be curved in the region of twisting.

In a further, particularly preferred, embodiment, the tube section has at least two curved sections with different radii of curvature. By way of example, an O-shaped or S-shaped configuration of the tube section would be suitable.

Finally, any desired combination of straight, twisted, curved sections, including with different radii of curvature and/or twisting angles, is also possible.

In a further preferred embodiment, it is also possible to provide a plurality of flow connection sections and tube sections. Independently of this, it is also possible to provide a plurality of collection spaces and/or distribution spaces. By way of example, a collection space can be flow-connected to a flow connection section, and a tube section can in turn be connected to this flow connection section, and this tube section in turn has a further flow connection section and a further collection or distribution space connected to it. This sequence can be extended or modified in any desired way.

In a preferred embodiment, the number of first and/or second flow connection sections is equal to the number of tube sections.

In a further preferred embodiment, the through-flow device has at least one flow passage, preferably a plurality of flow passages, for passing on the refrigerant, and preferably has a cross section in the form of a flat tube.

In the context of the present invention, the term in the form of a flat tube is to be understood as meaning that the cross section is substantially in the shape of a rectangle or ellipse, with the longer side of this rectangle being significantly longer than the shorter side or the longer semiaxis being significantly longer than the shorter semiaxis.

In a further preferred embodiment, the through-flow device is produced at least from a material selected from a group of materials consisting of metals, in particular aluminum, manganese, silicon, magnesium, iron, brass, copper, tin, zinc, titanium, chromium, molybdenum, vanadium, and alloys thereof, in particular wrought aluminum alloys with a silicon content of from 0 to 0.7% and a magnesium content of between 0.0 and 1%, preferably between 0.0% and 0.5%, and particularly preferably between 0.1% and 0.4%, preferably EN-AW 3003, EN-AW 3102, EN-AW 6060 and EN-AW 1100, plastics, fiber-reinforced plastics, composite material, etc.

In a further highly preferred embodiment, the first and/or second flow connection section is twisted over a predetermined angle. This predetermined angle results from the angle included by the perpendicular to the flattened region of the flat-tube-like through-flow device in the region upstream of the flow connection section with the perpendicular to the flattened region of the through-flow device downstream of the connection section. Both positive twisting angles and negative twisting angles are possible, the different signs indicating different directions of rotation of the twisting.

In a further preferred embodiment, the magnitude of the twisting angle is between 10 and 180 degrees, preferably between 45 and 135 degrees, and particularly preferably between 80 and 100 degrees.

In a further preferred embodiment, both the first flow connection section and the second flow connection section are twisted in the same direction of twisting, i.e. the signs of the twisting angles coincide with one another, and also the magnitude of the twisting angles substantially correspond to one another.

In a further preferred embodiment, the first and second flow connection sections are twisted in opposite directions of twisting, i.e. the magnitude of the twisting angles substantially correspond to one another but the twisting angles have different signs.

In a further preferred embodiment, the tube section is multiply twisted. In a further, highly preferred embodiment, the tube section is twisted at least twice in the same direction of twisting, i.e. the twisting angles have the same sign.

In a further embodiment, the tube section is twisted twice in different directions of twisting, i.e. the twisting angles have different signs.

In a further embodiment of the invention, the twisting angles of at least two twists of the tube section are substantially equal or equal in opposite directions.

In a further particularly preferred embodiment of the invention, the curved section and/or the twisted section of the tube section is connected to a supporting element. This may in this case take place in such a manner that the tube section is at least partially bent around the supporting element and is fixed at the positions of contact with the supporting element by a joining material, such as, for example, solder, adhesive or the like.

Of course, it is also conceivable to use other forms of connection, such as for example, screw connection, cohesive connection, positive connection or non-positive connection or the like.

In a further highly preferred embodiment, there are a plurality of, preferably two, collection/distribution spaces which are thermally separated from one another.

The term thermal separation is to be understood as meaning a state which completely or at least substantially prevents heat transfer between the components involved, for example the distribution and collection space. In a highly preferred embodiment, the thermal separation of the collection/distribution spaces is achieved by the distribution space and collection space being spaced apart from one another, so that an air gap is formed between the spaces.

In another highly preferred embodiment, the distribution space and the collection space are held spaced apart by means of bridge-like devices.

In a further particularly preferred embodiment, a material which effects thermal separation between the distribution space and the collection space is arranged between the distribution space and the collection space, and the distribution space and the collection space are cohesively connected to one another by means of this material.

In a further particularly preferred embodiment, the distribution space and/or the collection space have receiving devices or lead-through devices, the internal cross section of the receiving devices substantially corresponding to the external cross section of the through-flow device. In this case, the external cross section of the through-flow device is particularly preferably slightly smaller than the internal cross section of the receiving devices, so that the through-flow device, preferably a plurality of through-flow devices, can be pushed into the individual receiving devices or pushed through them. The receiving device may also be designed as a lead-through device, so that the through-flow device is pushed through the receiving device into the collection and/or distribution space. The receiving device may also be designed in such a way that a plurality of flat tubes can be accommodated therein.

In a further preferred embodiment, the receiving devices are substantially rectangular or elliptical in form, with the longer side of these substantially rectangular or elliptical receiving devices being arranged at a predetermined angle with respect to the longitudinal direction of the distribution and collection device. In this context, the longitudinal direction of the distribution/collection device is to be understood as meaning the direction in which the distribution/collection space substantially extends.

In another highly preferred embodiment, the magnitude of this predetermined angle between the longitudinal direction of the distribution/collection space is between 0 and 90 degrees, preferably between 0 and 45 degrees, and particularly preferably between 0 and 10 degrees. In this context, a rotation of the receiving device in the clockwise direction with respect to the longitudinal direction is indicated by a positive angle.

In a further preferred embodiment, a plurality of through-flow devices are arranged substantially parallel to one another. In this context, the term parallel arrangement is to be understood as meaning that in each case the flattened part of the flat-tube-like through-flow device is substantially parallel to the flattened part of the other through-flow devices. In a further highly preferred embodiment, cooling fins which promote heat exchange with the air flowing through or around are provided between the through-flow devices.

In a further, highly preferred embodiment, the tube sections of the through-flow devices and the supporting elements are at least partially connected to one another in a positive and/or non-positive manner.

In a further, highly preferred embodiment, frame devices are provided, which are at least in part connected positively, non-positively and/or cohesively to the supporting element and/or the collection and/or distribution space.

In a further preferred embodiment, there is at least one separating device dividing the collection space and/or the distribution space into at least two space sections in a gastight and liquid-tight manner. This separating section may, for example, be a wall which is pushed into the distribution and/or collection space and is soldered or adhesively bonded to it or joined to it in a similar way.

In a further, highly preferred embodiment, at least one space section of a collection/distribution space is flow-connected to at least one space section of another collection space distribution space by at least one connection device. This connection device may, for example, be a tubular element which is suitable for the fluid to pass through.

In a further, likewise highly preferred embodiment, the separating device is designed in such a way that in the region of the separating device the refrigerant flows through the connection device, which is formed integrally with the separating device, into another collection/distribution space. This causes the refrigerant to cross into another collection/distribution space.

The term cross is to be understood as meaning that the direction of flow of the refrigerant within the collection/distribution device is altered over a defined path region of the longitudinal direction of the collection/distribution device.

The result of an arrangement of this type is that the refrigerant does not immediately spread along the entire length of the apparatus, but rather first of all flows through the through-flow devices in a first section and then flows through the through-flow device in the opposite direction in a second section, resulting in a cross-countercurrent.

In a particularly advantageous embodiment, the separating device is arranged in such a manner that medium flows firstly through a first section, remote from the air flowing through, then through a section facing the air flowing through, then back through a section remote from the air flowing through and finally back through a section facing the air flowing through.

In further preferred embodiments, by using a plurality of separating devices, it is also possible to form a plurality of the abovementioned sections and in this way to make the refrigerant flow in cross-countercurrent form through the apparatus more often.

In a further, highly preferred, embodiment, a distribution space, a collection space, a through-flow device and a feed line and a discharge line are components which together form a module. It is possible for the overall apparatus for exchange to be provided with any desired dimensions by connecting a plurality of modules of this type in series.

The invention also relates to a device for exchange of air, in particular for motor vehicle air-conditioning systems having air flow paths, air flow control elements, at least one air delivery device and a housing which is suitable for receiving at least one apparatus for heat exchange or within which an apparatus for heat exchange of this type is arranged.

The invention preferably relates to a device for exchange of heat, in particular for motor vehicle air-conditioning systems, having at least one condenser, a compressor, an expansion valve, a collector and at least one apparatus for heat exchange.

The invention also relates to a process for producing a through-flow device, in particular a flat tube for an apparatus for heat exchange, the process comprising, as process steps, the production of a through-flow device extending substantially in a longitudinal direction and the twisting of at least one first end-side flow connection section and at least one second end-side flow connection section through a defined twisting angle.

In a particularly preferred procedure, the through-flow device is curved in the region through a predetermined bending angle with respect to the longitudinal direction of the through-flow device to produce a curved section. In this case, the bending angle is 0 degrees, 30 degrees, 45 degrees, 60 degrees, 90 degrees, 120 degrees or 180 degrees or any desired values in between. The longitudinal direction of the through-flow device is to be understood as meaning the direction in which the through-flow device substantially extends in the uncurved state.

The through-flow device is particularly preferably twisted in at least one region, the twisting angle amounting to 0 degrees, 30 degrees, 45 degrees, 60 degrees, 90 degrees, 120 degrees or 180 degrees or any desired values in between.

The invention is explained in more detail in the exemplary embodiment below with reference to the associated drawings, in which:

FIG. 1 diagrammatically depicts an apparatus for heat exchange in accordance with the invention;

FIG. 2 shows a perspective illustration of an apparatus for heat exchange in accordance with FIG. 1;

FIG. 3 diagrammatically depicts a through-flow device for an apparatus for heat exchange in accordance with the present invention;

FIG. 3*a* shows a diagrammatic plan view of a flow connection section on one side for an apparatus for heat exchange;

FIG. 4 diagrammatically depicts a collection space or distribution space for an apparatus for heat exchange in accordance with the present invention;

FIG. 4*a* shows an illustration on line A-A in FIG. 4;

Figure 5:
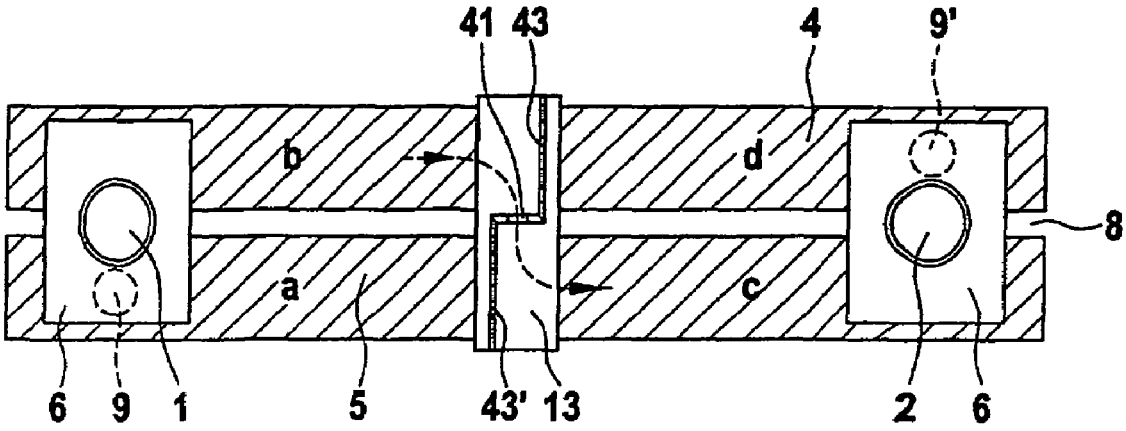
FIG. 5 shows a plan view of the illustration shown in FIG. 1.
Figure 6:
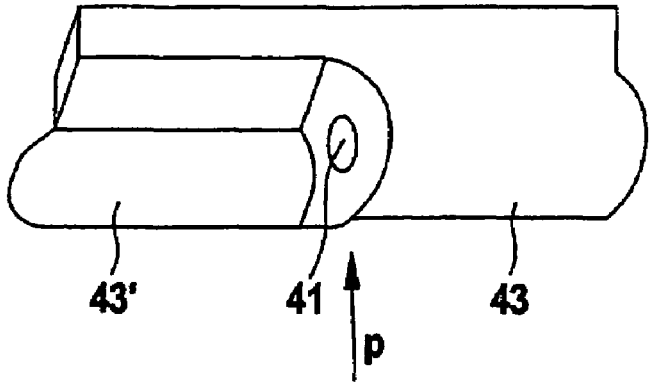
FIG. 6 shows a perspective illustration of the separating device from FIG. 5.
Figure 6A:
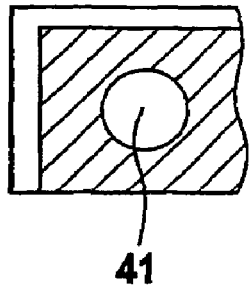
Figure 6B:
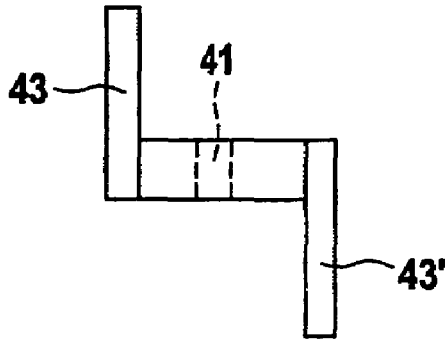
Figure 6C:
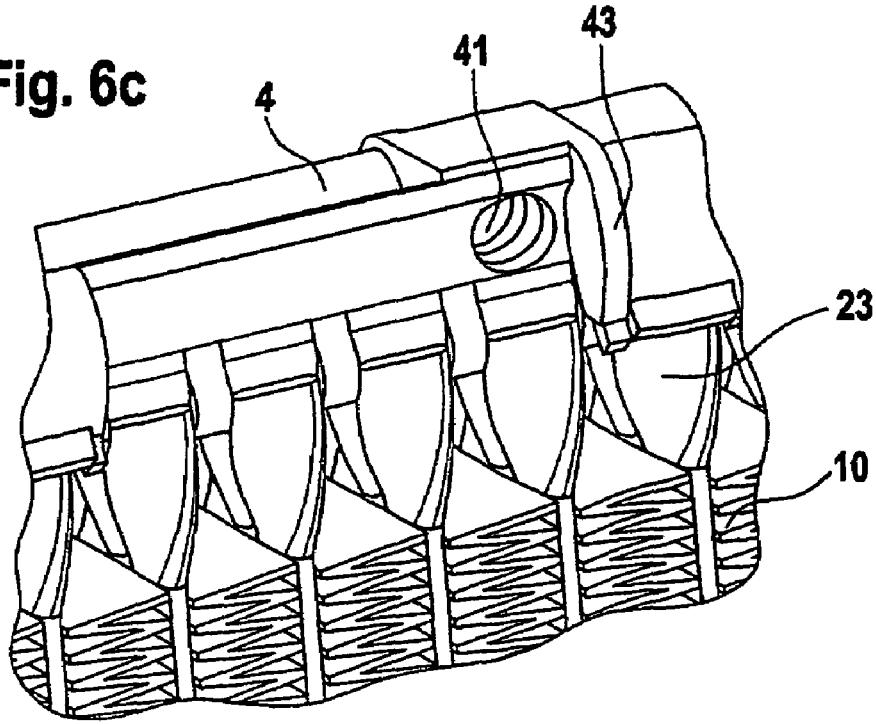
Figure 7:
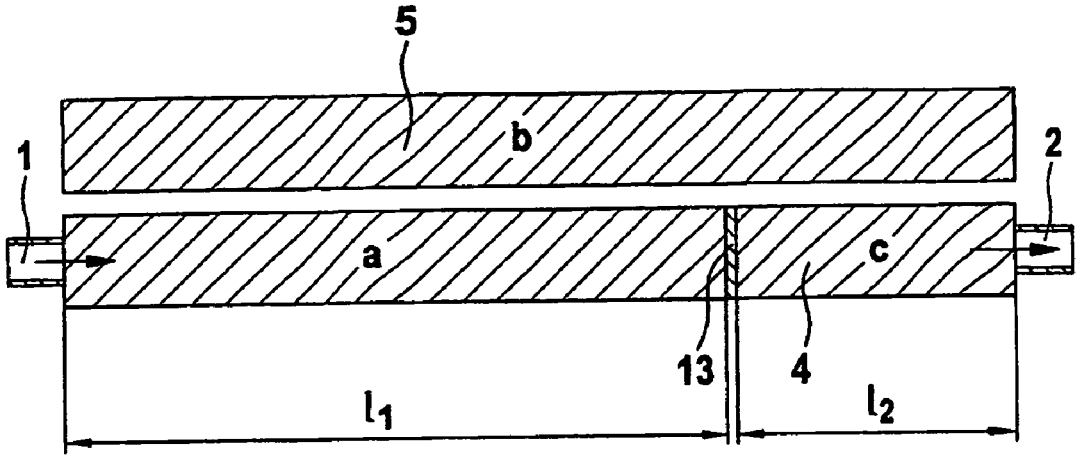
Figure 7A:
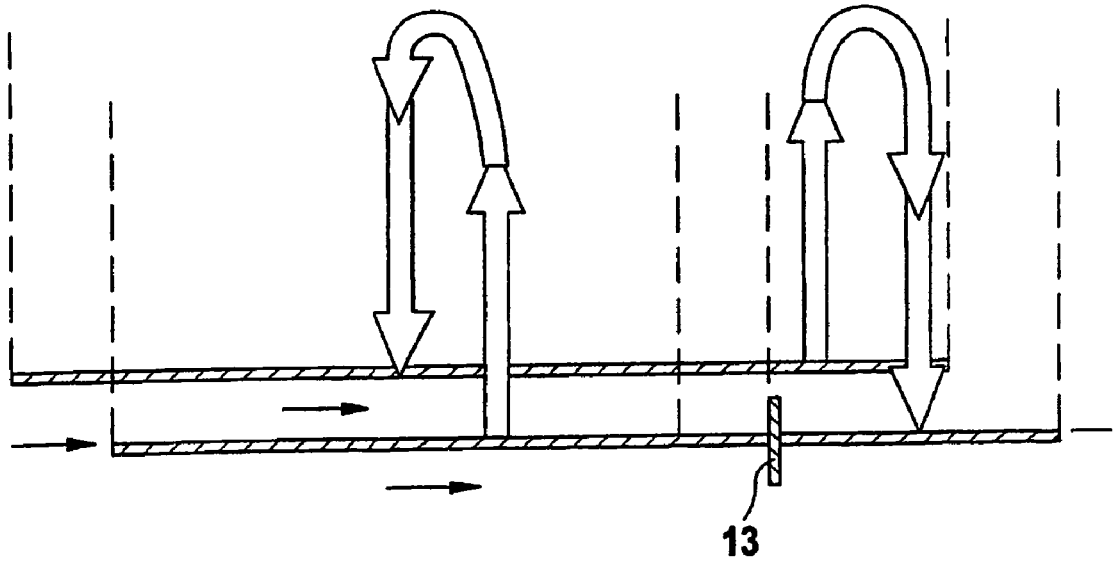
Figure 8:
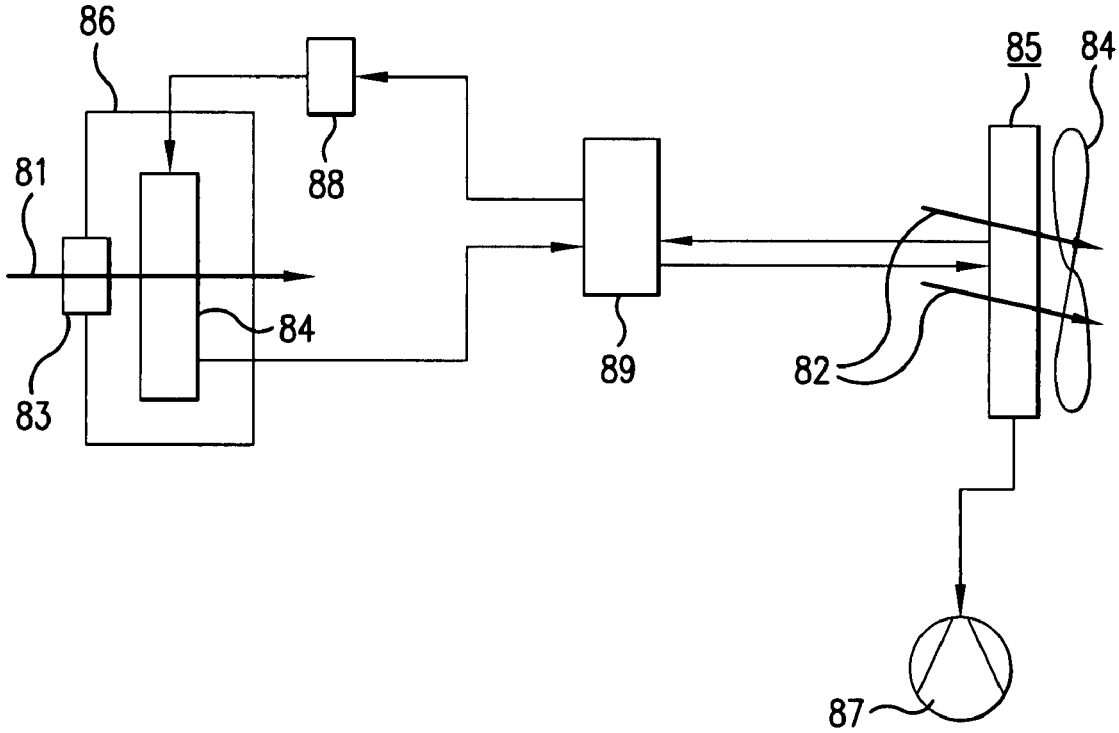

FIG. 6*a* shows a plan view of the separating device from FIG. 5;

FIG. 6*b* shows a further plan view of the separating device from FIG. 5;

FIG. 6*c* shows a perspective illustration of the separating device from FIG. 5 installed in the collection/distribution tube;

FIG. 7 diagrammatically depicts a further embodiment in accordance with the present invention, FIG. 7*a* shows a three-dimensional illustration of the direction of flow of the refrigerant in the embodiment shown in FIG. 7, and FIG. 8 depicts a heat exchange system.

Figure 1:
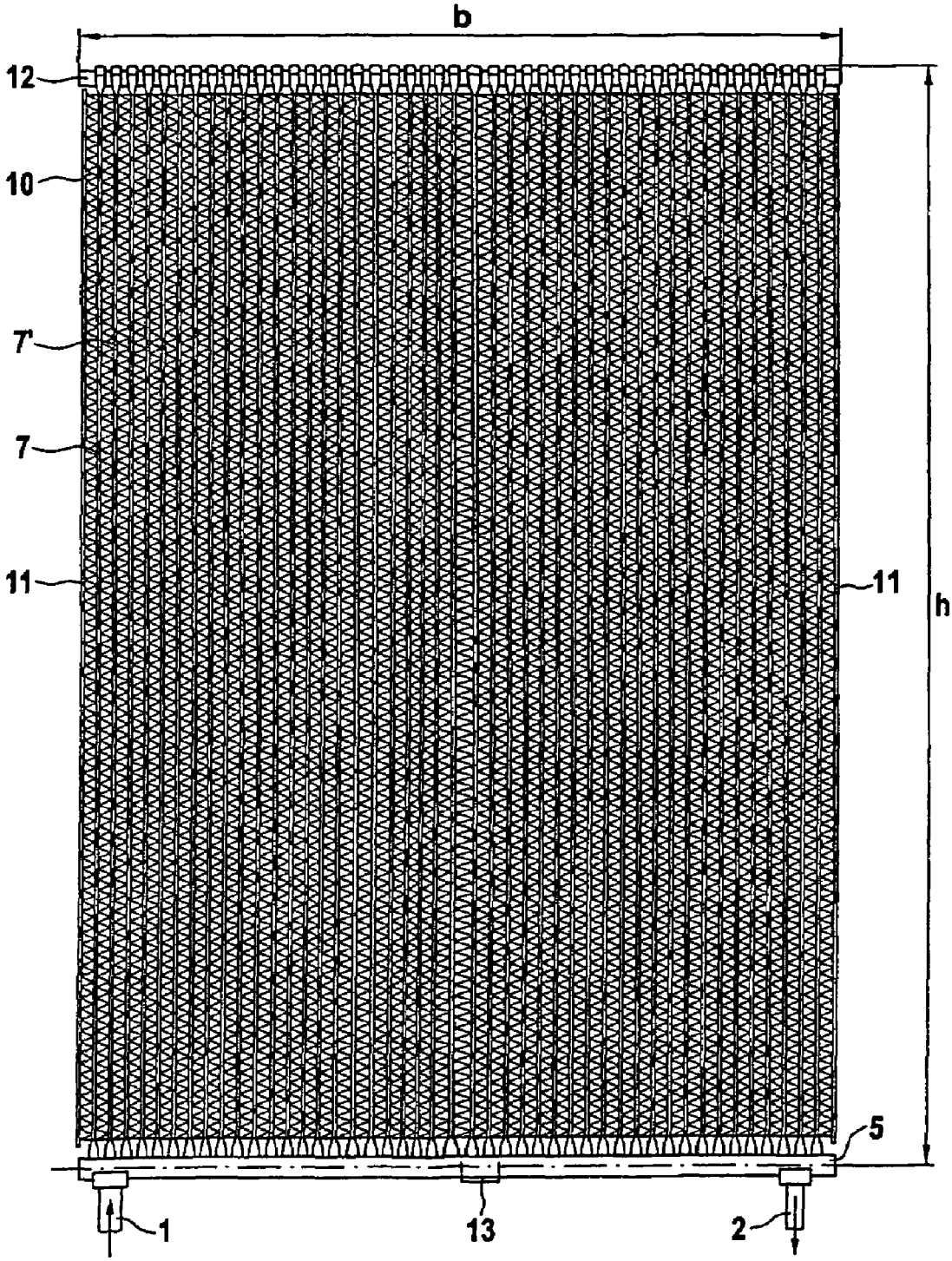
Figure 2:
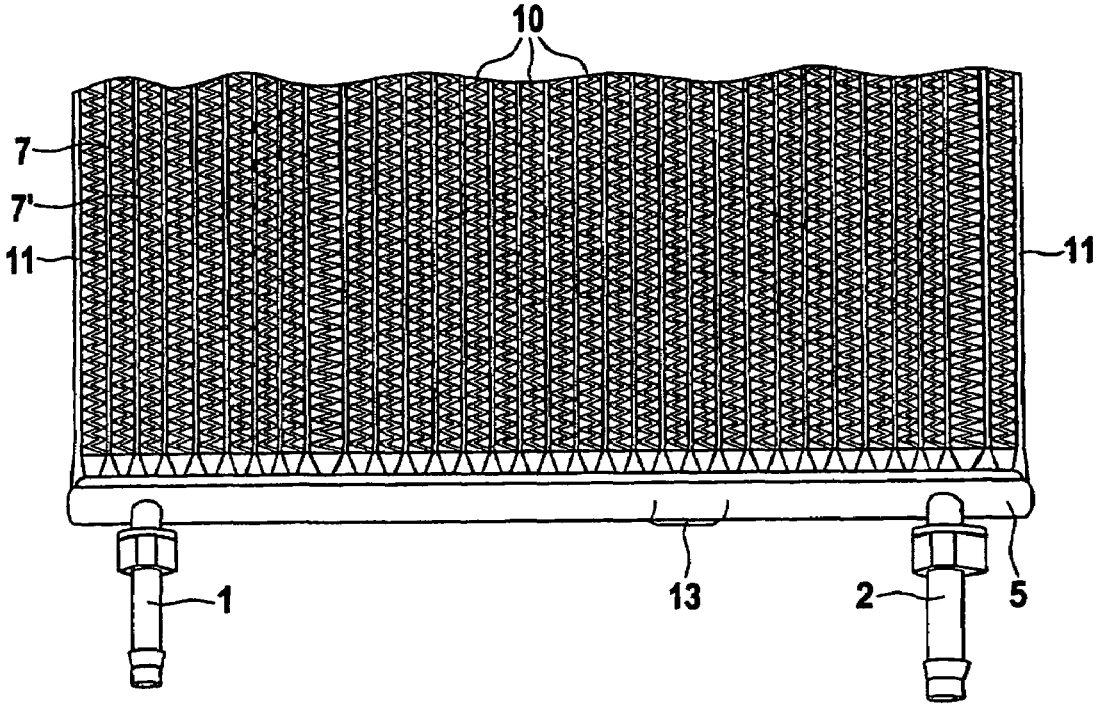

FIG. 1 illustrates an apparatus for heat exchange in accordance with the present invention. The apparatus has a feed line 1 and a discharge line 2. This feed line and this discharge line respectively open out into a distribution space and a collection space, in such a manner that they are flow-connected to these spaces. However, it is also possible for both the feed line and the discharge line to open out in the same space, which is then divided into two sub-spaces by a separating device.

In the present context, a collection space or distribution space is to be understood as meaning a volume element delimited in the longitudinal direction. This volume element may extend over the entire length 1 of the apparatus but may also be of a shorter length, for example if separating devices are provided.

Reference numeral 7 denotes a through-flow device through which a fluid can flow. It is preferable for a plurality of these through-flow devices (7, 7', 7") to be arranged in the apparatus for heat exchange. Cooling fins 10 are provided between these through-flow devices. These cooling fins for their part have gills (not shown in the illustration) which further promote heat exchange with the air flowing around them. The density of the cooling fins is 10-150 fins per dm, preferably 25 to 100 fins per dm, and particularly preferably 50 to 80 fins per dm.

The length of the gills is from 1 mm-20 mm, preferably between 2 mm and 15 mm, and particularly preferably from 3.5 to 12 mm. The width of the lamella slots is between 0.05 mm and 0.5 mm, preferably between 0.1 mm and 0.4 mm and particularly preferably between 0.2 mm and 0.3 mm.

Reference numeral 11 denotes a frame device which is at least partially connected positively, non-positively and/or cohesively to the collection space and/or the distribution space. In FIG. 1, the through-flow devices are configured in such a way that they are bent around a supporting apparatus 12. In this case, the through-flow device is bent through an angle of substantially 180° with respect to the longitudinal direction. There is provision for the individual through-flow devices to be connected to the supporting device, for example by a joining material, in particular solder, adhesive or the like. However, it is also possible to provide screw connections, riveted connections or the like.

The through-flow device has a cross section which is substantially in the form of a flat tube, as well as a flow passage or a multiplicity of flow passages for passing on the refrigerant. The individual flow passages are in this case substantially circular or elliptical in cross section. The cross section of the individual passages is between 0.2 mm and 3 mm, preferably between 0.5 mm and 2.0 mm and particularly preferably between 0.8 mm and 1.8 mm. The hydraulic diameter is between 0.1 mm and 3 mm, preferably between 0.4 mm and 2 mm and particularly preferably between 0.8 mm and 1.6 mm. The pressure ratio of the pressure of the refrigerant in the feed line and in the discharge line is between 1:1.5 and 1:20, preferably between 1:3 and 1:10 and particularly preferably between 1:4 and 1:6.

The distance between the individual through-flow devices along direction L is between 2 mm and 30 mm, preferably between 5 mm and 20 mm and particularly preferably between 8 mm and 14 mm.

The supporting device 12 is formed with a substantially circular cross section. However, it is also possible to provide other cross sections, e.g. elliptical cross sections or polygonal cross sections. The cross section of the supporting element is between 4 mm and 24 mm, preferably between 6 mm and 18 mm and particularly preferably between 8 mm and 12 mm.

It is also preferable for the supporting device 12 to be at least partially positively, non-positively and/or cohesively connected to the frame device(s) 11, suitable joining materials being, in particular, solder, adhesive or the like. However, it is also possible for screw connections, riveted connections or similar connections to be provided between the frame device(s) 11 and the supporting device 12.

The height h of the apparatus as shown in FIG. 1 is between 400 and 900 mm, preferably between 500 and 800 mm and particularly preferably between 650 and 750 mm.

Reference numeral 13 denotes a separating device which is used to divide the distribution spaces in a flow-tight manner. In one preferred embodiment, the separating device 13 is pushed into the collection and/or distribution space and then joined to the collection and/or distribution space, suitable joining materials being solder, adhesive or the like.

In the present context, the term flow-tight is to be understood as meaning that a medium cannot penetrate through a space which is has been closed off in this manner.

Figure 3:
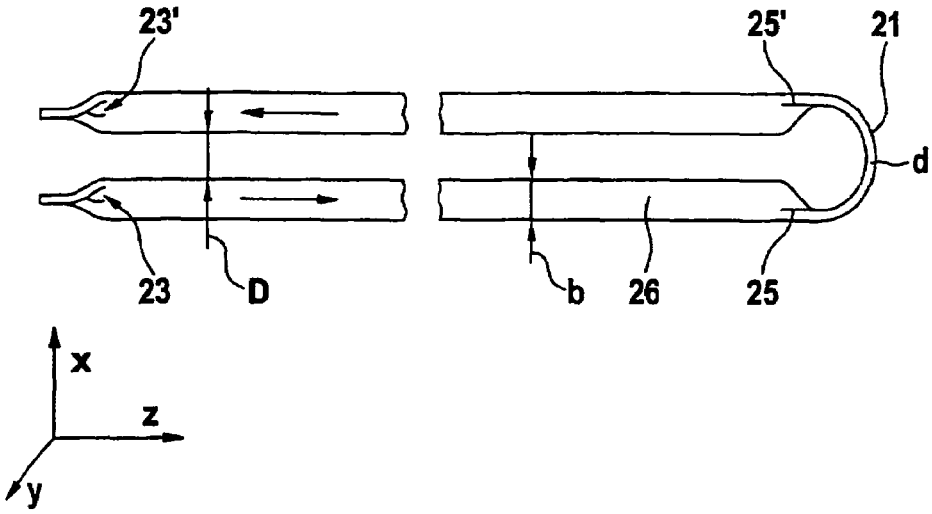

FIG. 3 diagrammatically depicts a through-flow device for an apparatus for heat exchange in accordance with the present invention.

In this figure, the two arrows denote the preferred direction of flow of fluid in the interior of the through-flow device. Reference symbols 23 and 23' denote a first end-side flow connection section and a second end-side flow connection section, respectively. Reference numerals 26 denote a tube section of the through-flow device. As can be seen from the illustration, the end-side flow connection section 23 and the end-side flow connection section 23' are each twisted once. In the present illustration, the twisting is through a twisting angle of 90 degrees. However, it is also conceivable to use twisting angles which differ from 90 degrees. In FIG. 3, the two flow connection sections are twisted in the same direction.

However, it is also possible for the twisting to be carried out in different directions.

Reference numeral 21 denotes a bent section of the through-flow device. The flattened side of the through-flow device is perpendicular to the plane of the drawing.

Reference numerals 25 and 25' denote further twisted sections of the tube section 26 of the through-flow device. In this case, the twisting in the twisted section 25 is through a twisting angle of minus 90 degrees and in the twisted section 25' is plus 90 degrees. However, in this case too it is conceivable to use other twisting angles, both in terms of magnitude and sign.

The width b of the through-flow device is between 2 mm and 12 mm, preferably between 4 mm and 8 mm, and, very particularly preferably, between 5 mm and 7 mm.

The distance d between the flat tube section in which the fluid moves substantially in the longitudinal direction and the flat tube section in which the medium moves substantially in the opposite direction to the longitudinal direction 1 is between 0.1 mm and 6 mm, preferably between 0.8 mm and 4 mm and particularly preferably between 1 mm and 2 mm.

In one particularly preferred embodiment, said tube sections do not touch one another. This prevents heat exchange between the two tubes. It is also possible for a medium which allows thermal separation to be disposed between the two tube sections 26*a* and 26*b*.

In a further highly preferred embodiment, it is also possible for the cooling fins 10 to be designed in such a way that they do not run continuously along the flat side of the flow device 26, but rather are likewise divided into two cooling fin strands 10*a* and 10*b*. The thickness of the through-flow device is between 0.1 mm and 5 mm, preferably between 0.3 mm and 4 mm, and particularly preferably between 0.8 mm and 2 mm.

Figure 3A:
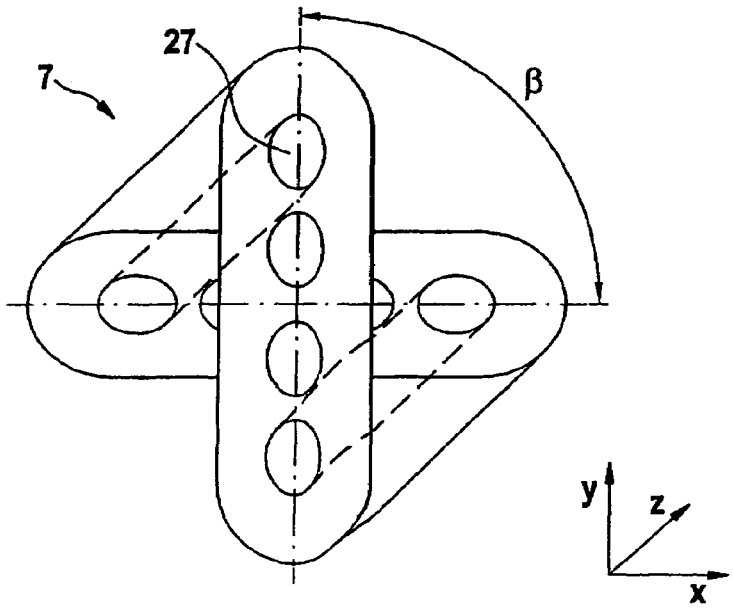

FIG. 3*a* diagrammatically depicts the cross section through the through-flow device 7 in the region of an end-side flow connection section 23. The through-flow device has one or preferably a plurality of flow passages 27.

Furthermore, FIG. 3*a* serves to illustrate the twisting. In the example shown here, the through-flow device is twisted through 90° in the counterclockwise direction in the direction of the positive z axis, i.e. is rotated through a twisting angle β of −90°. By this definition, the separate twists of the two end-side flow connection sections 23 and 23' shown in the figure have a twisting angle with a magnitude of 90° and a negative sign, i.e. of −90°.

Figure 4:
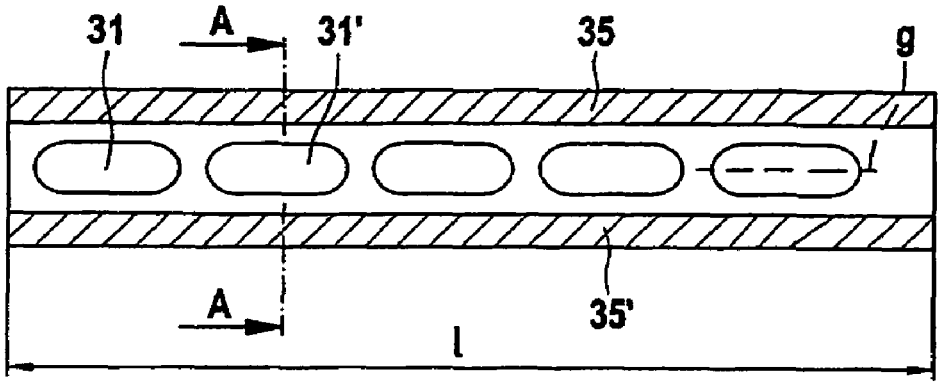

FIG. 4 diagrammatically depicts a distribution or collection space. The distribution or collection space has a multiplicity of receiving devices 31 and 31'. These receiving devices are used to receive and lead through the through-flow device 7. The internal diameter of these lead-through devices substantially corresponds to the external cross section of the through-flow device 7 and is preferably slightly greater. During production, the end sections of the through-flow device are pushed into the receiving devices 31 and 31'. It is preferable for the connection location then to be closed, for example by clamping together the clamping walls 35 and 35', with the result that the through-flow device is pressed into the distribution or collection space. Then, the receiving devices and the through-flow devices are joined, for example by means of solder, adhesive or the like.

The clamp-like connection between the through-flow devices and the receiving devices of the collection or distribution space provides the advantage that it is possible to absorb even the high pressures of up to approx. 300 bar which are required in carbon dioxide coolers, and the flow paths still remain gastight and/or liquid-tight even at these high pressures.

In a preferred embodiment, the depth of insertion of the through-flow devices into the collection or distribution space is limited by the twisting of the end-side flow connection section. However, it is also possible for the through-flow devices to be pushed in all the way to the bottom of the distribution or collection space. The depth of insertion is between 1 mm and 12 mm, preferably between 3 mm and 9 mm and particularly preferably between 4 mm and 8 mm.

The individual receiving devices 31 and 31' are arranged along the longitudinal direction L of the receiving space and/or the collection space, i.e. their longitudinal direction, which is indicated by the dashed section g, includes an angle of a magnitude of less than 10 degrees, preferably substantially 0°, with the longitudinal direction 1. However, it is also possible for the receiving devices to be arranged at a different angle of up to 90° with respect to the longitudinal direction.

Figure 4A:
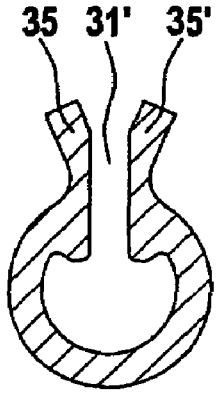

FIG. 4*a* shows a section from FIG. 4 on line A-A. Reference numerals 35 and 35' denote the clamping walls which are used to clamp in the flow connection section. Reference numeral 31 shows the receiving device, illustrated in the form of a gap in this sectional representation. As can be seen from FIG. 4*a*, the flow connection section has a substantially Ω-shaped cross section.

FIG. 5 shows a plan view of an apparatus for heat exchange in accordance with the present invention. Reference numerals 4 and 5 denote two collection and distribution spaces. In a preferred embodiment, the two collection and distribution spaces do not directly touch one another but rather are spaced apart from one another as indicated by reference numeral 8.

In a preferred embodiment, an air gap is provided between the two distribution and collection spaces, thermally separating the two spaces. However, it is also possible for the two spaces to be connected using a thermally insulating material, i.e. a material with a low heat conduction coefficient. In a preferred embodiment, the collection space is connected to the distribution space by means of the web-like separation device 13. Further connection devices 6 are used to receive the feed line 1 and the discharge line 2.

In a further, highly preferred embodiment, the separation apparatus 13 divides the distribution and/or collection space into two separate subspaces.

The distribution space and the collection space have a length along the longitudinal direction L of between 100 and 800 mm, preferably between 30 mm and 600 mm and particularly preferably between 400 mm and 500 mm.

FIG. 6 diagrammatically depicts a separating direction for an apparatus for heat exchange according to the present invention. The separating device has an opening 41 and a partition 43. In a preferred embodiment, the separating device is pushed into prepared slots in the distribution or collection spaces. The separating device is preferably soldered or welded, or joined in some other way, to the distribution or collection space.

FIG. 6*a* illustrates a side view of the separating device from FIG. 6. The partition 43 projects into the plane of the drawing in this illustration.

FIG. 6*b* shows a further side view of the separating device in the direction indicated by arrow P from FIG. 6. The opening 41, which is concealed in this illustration, is indicated by dashed lines.

FIG. 6*c* shows a perspective illustration of the separating device 13 installed in the collection/distribution spaces.

The separating devices ensure that the refrigerant is not distributed to the individual through-flow devices over the entire length of the distribution or collection tube, but rather initially across those in a first subsection from where it passes via the through-flow devices into a corresponding first subsection of the second collection/distribution space. From there, the medium flows via the opening 41 of the separating device 43 into the second space of the first collection/distribution space in order ultimately to pass via the through-flow device into a second part of the second collection space.

This path is diagrammatically depicted in FIG. 5. The refrigerant passes via the feed line 1 and the opening 9 indicated by dashed lines into the space section denoted by a. From there, it flows via the through-flow device into the section b, from where the refrigerant flows via the opening 41 of the separating device 13 crossing into the section c, as illustrated by the dashed line in FIG. 5. From section c, the refrigerant passes via the through-flow devices into the section d, from where it is ultimately fed to the discharge line 2 via the opening 9' indicated by dashed lines.

In other preferred embodiments, however, it is also possible to provide a plurality of separating devices. It is in this way possible for the refrigerant to be passed repeatedly into a plurality of distribution/collection space sections. The advantage of an embodiment of this type consists in a more uniform division of the different heat transfer regions of the apparatus according to the invention.

It is also possible, in a preferred embodiment, not to provide a separating device, so that the distribution space and the collection space are in each case formed by the full spaces extending in the longitudinal direction. To clarify, it should be noted that the collection space is not to be understood as meaning the complete volume shown in FIG. 3, but rather in each case only individual space sections which are divided by the separating devices. The separating devices have the advantage that the flow of refrigerant is distributed more advantageously over the area of the apparatus for heat exchange through which air flows.

In a further particularly preferred embodiment, two distribution or collection spaces are provided. At least one of these two distribution or collection spaces, preferably one of the two collection or distribution spaces, is provided with at least one, preferably precisely one, separating device. This separating device divides the distribution or collection space into two subspaces. The distribution or collection space provided with the separating device also has a feed line and a discharge line. The two distribution or collection spaces are preferably flow-connected only via the through-flow device. In this case, the through-flow device has at least one flow passage, preferably a multiplicity of flow passages, for passing on the refrigerant, and particularly preferably has a cross section in the form of a flat tube.

It is also possible for a plurality of separating devices to be provided instead of one separating device. By way of example, it is possible for the collection or distribution space which is provided with the feed line and the discharge line to have two separating devices and for the other distribution or collection space to have one separating device, which is preferably located between the two separating devices of the first distribution or collection space, as seen in the longitudinal direction of the distribution or collection space.

In general terms, it is possible for n separating devices to be provided in the distribution or collection space which is provided with the feed line and discharge line and for n-1 separating devices to be provided in the other distribution or collection space, these n-1 separating devices in each case being arranged in such a way that the individual separating devices are arranged alternately at the two collection or distribution spaces, as seen in the longitudinal direction of the collection or distribution spaces. It is in this way possible to determine how often the fluid is passed to and fro between the two distribution or collection spaces.

FIG. 7 shows a diagrammatic illustration of this embodiment. Reference numerals 4 and 5 denote the two distribution and collection spaces. Reference numerals 1 and 2 denote a feed line and a discharge line respectively, which is used to introduce a fluid into a distribution or collection space 5. In this case, the feed line and the discharge line extend substantially in the longitudinal direction of the distribution or collection device 5. However, it is also possible for the feed line to be provided elsewhere in the distribution or collection device 5 or 4. By way of example, they may be designed in such a manner that they extend perpendicular to the longitudinal direction of the distribution or collection space, for example, downward as seen in the drawing or out of the plane of the drawing. Other directions of extent are also possible, depending on the spatial requirements. It is also possible for the feed and discharge lines to be arranged at the underside of the distribution or collection space 5.

Reference numeral 13 denotes a separating device, which is provided in the distribution or collection space 5 in such a manner that this distribution or collection space is divided into two subsections. As can be seen from FIG. 7, in this embodiment there is no direct connection between the two distribution or collection spaces 4 and 5, but rather the flow connection is in this case via the individual through-flow devices. The separating device is arranged in such a way that the longitudinal ratios of the collection and distribution device 5 between the space section facing the feed line and the space section facing the discharge line, which are represented by the ratio of the lengths $l_1$ and $l_2$ indicated in FIG. 7, are between 9:1 and 1:9, preferably between 9:1 and 1:3, particularly preferably are approx. 2:1. These dimensions depend on the degree of condensation and/or the density ratio upstream and downstream of the sectional cooling of the fluid.

The direction of flow within the apparatus is explained with reference to FIGS. 7 and 7*a*.

Through the feed line 1, the fluid passes firstly into the subsection a of the distribution or collection space 5. From there, as shown in FIG. 7*a*, it flows via the through-flow device (not shown) into the distribution or collection space 4. Since there is no separating device provided in this distribution or collection space 4, the fluid can be distributed over the entire length of the distribution or collection space 5 as indicated by letter b. From here, the fluid flows, now in the reverse direction, through the through-flow device and ultimately passes into the second subsection, denoted by c, of the distribution or collection device 5. From there, the fluid can flow out via the discharge line 2. The advantage of this arrangement consists in a more uniform exchange of heat with the surrounding medium.

FIG. 8 depicts a conventional heat exchange system (see, e.g., U.S. Pat. No. 6,434,972) that includes air flow paths 81, 82, air flow control elements 83 in an air delivery device, an evaporator 84, a condenser 85, a housing for receiving an apparatus for heat exchange 86, a compressor 87, an expansion valve 88, and a collector 89.

It should be noted that the invention is not restricted to the embodiments illustrated in the figures but rather can be modified and expanded in various ways.

The invention claimed is:

1. An apparatus for heat exchange for use in motor vehicle air conditioning systems which, as refrigerant, include a fluid with carbon dioxide ($CO_2$) as at least one constituent, the apparatus comprising:

at least one feed line and discharge line, which open out into a distribution or collection space, respectively, for a fluid, and at least one through-flow device, the through-flow device comprising:

at least one first end-side flow connection section, through which the fluid enters the through-flow device or leaves the through-flow device, at least one second end-side flow connection section, through which the fluid leaves the through-flow device or enters the through-flow device, and wherein the first flow connection section is flow-connected to the second flow connection section by at least one tube section, wherein at least one of the flow connection sections is twisted at least once, wherein the first or second flow connection section is flow-connected to the collection space, wherein the second or first flow connection section is flow-connected to the distribution space, wherein at least one space section of the distribution space is flow-connected to at least one space section of the collection space by at least one connection device, wherein a separating device is arranged in such a manner that medium flows firstly through a first section, remote from the air flowing through, then through a section facing the air flowing through, then back through a section remote from the air flowing through and finally back through a section facing the air flowing through, and wherein there is at least one separating device dividing the collection space and/or the distribution space into at least two space sections in a gas-tight and fluid-tight manner and the at least one separating device comprises two separating walls with one of the separating walls being arranged at a right angle and with an opening.

2. An apparatus for heat exchange as claimed in claim 1, wherein the tube section has at least one straight section.

3. An apparatus for heat exchange, as claimed in claim 1, wherein the tube section has at least one curved section.

4. An apparatus for heat exchange as claimed in claim 1, wherein the tube section has at least one twisted section.

5. An apparatus for heat exchange as claimed in claim 1, wherein the tube section has at least two curved sections with different radii of curvature.

6. An apparatus for heat exchange as claimed in claim 1, wherein the number of first and/or second flow connection sections is equal to the number of tube sections.

7. An apparatus for heat exchange as claimed in claim 1, wherein the through-flow device has at least one flow passage, preferably a plurality of flow passages for passing on the refrigerant, and preferably has a cross section in the form of a flat tube.

8. An apparatus for heat exchange as claimed in claim 1, wherein the through-flow device is made at least from a material selected from a group of materials consisting of metals, in particular aluminum, manganese, silicon, magnesium, iron, brass, copper, tin, zinc, titanium, chromium, molybdenum, vanadium, and alloys such as EN-AW 3003, EN-AW 3102, EN-AW 6060, EN-AW 1110 thereof, plastics, fiber-reinforced plastics, composite materials.

9. An apparatus for heat exchange as claimed in claim 1, wherein at least the first and/or second flow connection section is twisted over a predetermined angle.

10. An apparatus for heat exchange as claimed in claim 1, wherein the magnitude of the twisting angle is between 10° and 180°.

11. An apparatus for heat exchange as claimed in claim 1, wherein the two transition sections are twisted in the same twisting direction.

12. An apparatus for heat exchange as claimed in claim 1, wherein the two transition sections are twisted in opposite twisting directions.

13. An apparatus for heat exchange as claimed in claim 1, wherein the tube section is multiply twisted.

14. An apparatus for heat exchange as claimed in claim 1, wherein the tube section is twisted at least twice in the same twisting direction.

15. An apparatus for heat exchange as claimed in claim 1, wherein the tube section is twisted at least twice in different twisting directions.

16. An apparatus for heat exchange as claimed in claim 1, wherein the twisting angles of at least two twists of the tube section are substantially equal or equal in opposite directions.

17. An apparatus for heat exchange as claimed in claim 1, wherein the curved section and/or the twisted section of the tube section is connected to a supporting element.

18. An apparatus for heat exchange as claimed in claim 1, wherein a plurality of distribution/collection spaces which are thermally separated from one another are provided.

19. An apparatus for heat exchange as claimed in claim 1, wherein the thermal separation is effected by a plurality of distribution/collection spaces being spaced apart from one another.

20. An apparatus for heat exchange as claimed in claim 1, wherein thermal separation is effected by providing a material which promotes thermal separation between the distribution/collection spaces.

21. An apparatus for heat exchange as claimed in claim 1, wherein the distribution/collection space has receiving devices, the internal cross section of the receiving devices substantially corresponding to the external cross section of the through-flow device.

22. An apparatus for heat exchange as claimed in claim 1, wherein the receiving devices are substantially rectangular in form, and the longer side of these receiving devices is arranged at a predetermined angle with respect to the longitudinal direction of the distribution/collection device.

23. An apparatus for heat exchange as claimed in claim 1 wherein the magnitude of the angle is between 0° and 90°.

24. An apparatus for heat exchange as claimed in claim 1, wherein a plurality of through-flow devices are arranged substantially parallel to one another.

25. An apparatus for heat exchange as claimed in claim 1, wherein cooling fins are provided between the through-flow devices.

26. An apparatus for heat exchange as claimed in claim 1, wherein the tube sections of the through-flow devices and the supporting element are at least partially connected to one another positively, cohesively and/or non-positively.

27. An apparatus for heat exchange as claimed in claim 1, wherein frame devices are provided and are at least partially connected positively, non-positively and/or cohesively to the supporting element and/or the collection/distribution space.

28. An apparatus for heat exchange as claimed in claim 1, wherein two distribution and/or collection spaces are provided at least one separating device is provided, dividing at least one of the two distribution and/or collection spaces into at least two space sections in a gastight and liquid-tight manner, and the two distribution and/or collection spaces are in flow connection only via the at least one through-flow device.

29. An apparatus for heat exchange as claimed in claim 1, wherein the feed line and discharge line are provided at one of the two collection and/or distribution spaces, preferably at the distribution and/or collection space which has the separating device.

30. An apparatus for heat exchange as claimed in claim 1, wherein the feed line and the discharge line extend substantially in the longitudinal direction of the distribution or collection space at which they are arranged.

31. An apparatus for heat exchange as claimed in claim 1, wherein the separating device divides the distribution or collection space in such a way that the ratio of the length of the section facing the feed line to the length of the section facing the discharge line is between 9:1 and 1:5.

32. An apparatus for heat exchange as claimed in claim 1, wherein at least one space section of a first distribution/collection space is flow-connected to a further space section of a second distribution/collection space by at least one connecting device, the first distribution/collection space and the second distribution/collection space not lying on a straight line.

33. An apparatus for heat exchange as claimed in claim 1, wherein the connection device is provided in the region of the separating device and is preferably formed integrally with the separating device.

34. An apparatus for heat exchange, heat exchange as claimed in claim 1, wherein a plurality of separating/connection devices, which are preferably in single-part form, are provided and effect multiple diversions of the refrigerant.

35. An apparatus for heat exchange as claimed in claim 1, wherein a distribution space, a collection space, a through-flow device and a feed and discharge line are components which form a module.

36. A device for exchanging air for motor vehicle air-conditioning systems, having air flow paths, air flow control elements, at least one air delivery device and a housing which is suitable for receiving at least one apparatus for heat exchange as claimed in claim 1, or within which an apparatus for heat exchange of this type is arranged.

37. A device for exchanging heat for motor vehicle air-conditioning systems, having at least one condenser, a compressor, an expansion valve, a collector and at least one apparatus for heat exchange as claimed in claim 1.

38. A process for producing a flat tube for an apparatus for heat exchange according to claim 1, the process comprising:

production of a through-flow device extending substantially in one longitudinal direction;

twisting of at least one first end-side flow connection section and at least one second end-side flow connection section through a predetermined twisting angle.

39. A process for producing a through-flow device as claimed in claim 38, wherein the through-flow device is curved in the region around a predetermined bending angle with respect to the longitudinal direction of the through-flow device to produce a curved section.

40. A process for producing a through-flow device as claimed in claim 38, wherein the bending angle is about 0°, 30°, 45°, 60°, 90°, 120° or 180°.

41. A process for producing a through-flow device as claimed in claim 38, wherein the through-flow device is twisted at least in one region, the twisting angle is about 0°, 30°, 45°, 60°, 90°, 120° or 180°.

42. An apparatus for heat exchange as claimed in claim 1, wherein the magnitude of the twisting angle is between 45° and 135°.

43. An apparatus for heat exchange as claimed in claim 1, wherein the magnitude of the twisting angle is between 80° and 100°.

44. An apparatus for heat exchange as claimed in claim 1 wherein the magnitude of the angle is between 0° and 45°.

45. An apparatus for heat exchange as claimed in claim 1 wherein the magnitude of the angle is between 0° and 10°.

46. An apparatus for heat exchange as claimed in claim 1, wherein the separating device divides the distribution or collection space in such a way that the ratio of the length of the section facing the feed line to the length of the section facing the discharge line is between 5:1 and 1:1.

47. An apparatus for heat exchange as claimed in claim 1, wherein the separating device divides the distribution or collection space in such a way that the ratio of the length of the section facing the feed line to the length of the section facing the discharge line is approximately 2:1.

48. A process for producing a through-flow device as claimed in claim 38, wherein the bending angle is between 0° and 180°.

49. A process for producing a through-flow device as claimed in claim 38, wherein the through-flow device is twisted at least in one region, the twisting angle is between 0° and 180°.

* * * * *